United States Patent [19]

Niemiro et al.

[11] Patent Number: 4,526,099

[45] Date of Patent: Jul. 2, 1985

[54] REVERSIBLE COLOR DECK FOR ROTARY PRINTING PRESSES

[75] Inventors: Thaddeus A. Niemiro, Lisle; Daniel F. Machaj, Hinsdale, both of Ill.

[73] Assignee: Rockwell International Corporation, Pittsburgh, Pa.

[21] Appl. No.: 466,827

[22] Filed: Feb. 16, 1983

[51] Int. Cl.[3] ..... B41F 5/08

[52] U.S. Cl. ..... 101/220; 101/179; 101/182

[58] Field of Search ..... 101/177, 179, 180, 181, 101/220, 182, 219

[56] References Cited

U.S. PATENT DOCUMENTS

| | | | |
|---|---|---|---|
| 3,329,086 | 7/1967 | Pullen | 101/177 |
| 3,452,672 | 7/1969 | Bolza-Schunemann et al. | 101/177 |
| 4,217,823 | 8/1980 | Burger | 101/179 |
| 4,250,809 | 2/1981 | Pullen | 101/177 |
| 4,369,705 | 1/1983 | Gelinas | 101/177 |

FOREIGN PATENT DOCUMENTS

| | | | |
|---|---|---|---|
| 137828 | 9/1979 | German Democratic Rep. | 101/177 |
| 1197056 | 7/1970 | United Kingdom | 101/179 |
| 1203968 | 9/1970 | United Kingdom | 101/179 |

*Primary Examiner*—William Pieprz

[57] ABSTRACT

A reversible color deck apparatus for rotary printing presses for permitting a printer to selectively print a plurality of colors on one side or the other of a paper web. The apparatus includes a plurality of image delivery rolls or cylinders disposed in spaced relation. A pair of blanket rolls or cylinders are disposed within the space separating the image delivery rolls and are supported at their ends by eccentric sleeve elements. These sleeve elements are operatively interconnected by control linkage which, in turn, is connected to an actuating member for effecting simultaneous movement of the axes of rotation of the blanket rolls in the same directions. Via a neutral or throw off position, the axes of rotation of the blanket rolls can be moved to two different positions which permit the printing of a plurality of colors on that side of the web corresponding to the particular position to which the blanket rolls were selected to be moved.

4 Claims, 5 Drawing Figures

REVERSIBLE COLOR DECK FOR ROTARY PRINTING PRESSES

BACKGROUND OF THE INVENTION

1. Field of the Invention.

The invention pertains to a reversible color deck apparatus for rotary printing presses and, more particularly, to such a device which allows a printer to selectively change the operating position of the press blanket rolls whereby a plurality of colors can be printed either on one side or the other of a paper web.

2. Description of the Prior Art.

Devices for changing the operating position of blanket rolls in offset printing presses are well known to those conversant in the art and, for a more detailed description of the teachings of such a device, attention is hereby directed to U.S. Pat. No. 3,329,086. Unlike the present invention, the teachings of this patent disclose elements for causing the blanket rolls to be simultaneously moved in opposite directions to operating positions which selectively permit single color printing simultaneously on both sides of a web or multicolor printing on one side only of a web.

SUMMARY OF THE INVENTION

The device according to the invention for selectively printing a plurality of colors either on one side or the other of a paper web includes a plurality of image delivering rolls disposed in spaced relation with a pair of blanket rolls located within the space separating the image delivering rolls. The blanket rolls are supported at their ends by eccentric sleeve elements which are operatively interconnected by control linkage which, in turn, is connected to a fluid actuator of the double acting type. When the press is not operating, the blanket rolls are moved to a neutral or throw off position by the fluid actuator which, upon startup of the press, is selectively effective in causing simultaneous movement of the axes of rotation of the blanket rolls in the same directions. The axes of rotation of the blanket rolls can be moved to two different positions which permit the printing of a plurality of colors on that side of the web corresponding to the particular position to which the blanket rolls were selected to be moved.

It is a general object of the invention to provide a device for rotary printing presses for selectively printing a plurality of colors either on one side or the other of a paper web.

A further object is to provide a device for selectively moving the axes of rotation of the press blanket rollers in the same directions to positions for effecting printing on one side of the other of a web.

A further object is to provide a device that can be quickly and easily adjusted to effect movement of the axes of the blanket rollers in one direction or the other.

These and other objects of the invention will become more fully apparent by reference to the appended claims and as the following detailed description proceeds in reference to the figures of drawing wherein:

DESCRIPTION OF THE PREFERRED EMBODIMENT

Figure 1:
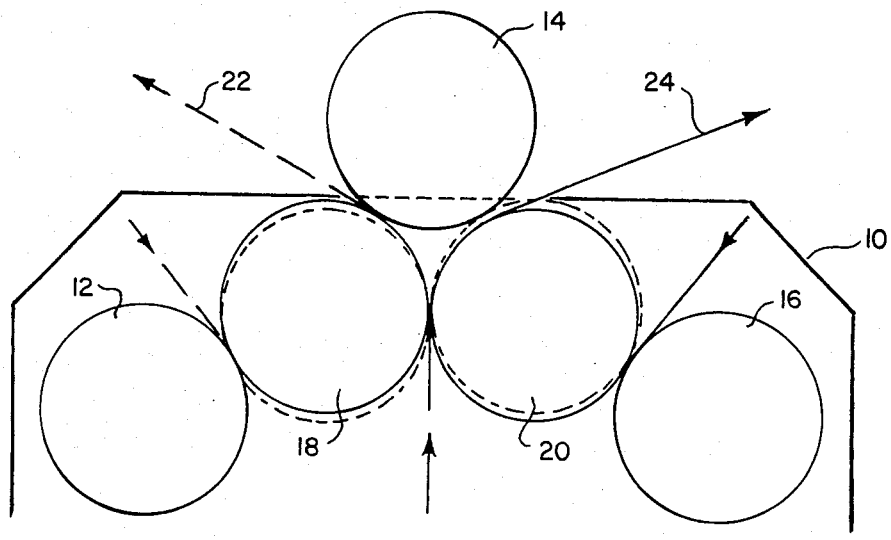
FIG. 1 is a diagrammatic end view of the image delivering and blanket rolls showing, by means of full and dotted lines of the latter, their positions for printing on one side or the other of a paper web.

Now referring to the figures of drawing, enough of a rotary or offset printing press is shown in FIG. 1 to serve as a basis for a detailed description of the invention applied thereto. The rotary printing press, which will hereinafter be referred to as the "press", includes a pair of spaced frame members 10 with one only being shown in FIG. 1. In this figure of drawing, the frame members are shown supporting three image delivering or plate rolls spaced apart in substantially triangular relationship to one another and are identified by numerals 12, 14 and 16, respectively. A pair of blanket rolls depicted by numerals 18 and 20 are also supported by the frame members 10 and are located within the space separating the image delivering rolls.

Figure 2:
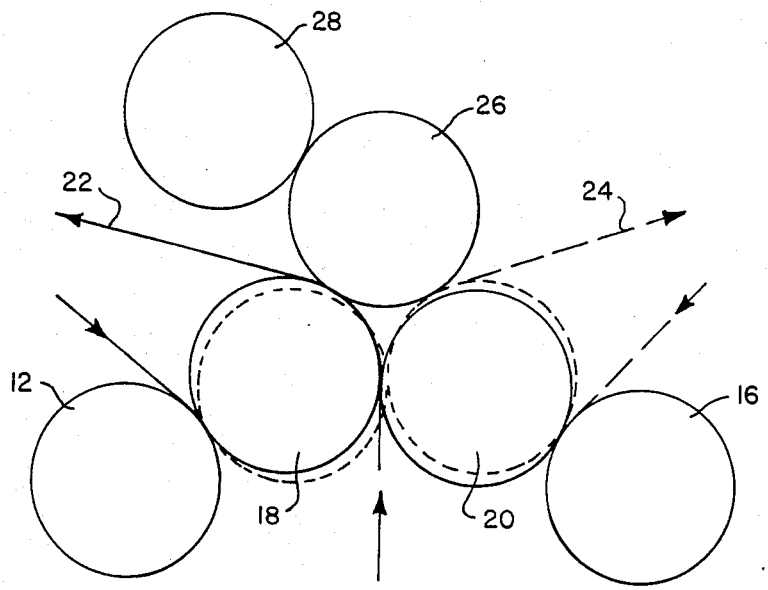
FIG. 2 is a view similar to FIG. 1 but with the addition of another blanket roll.

By a mechanism yet to be described, the blanket rolls 18 and 20 are selectively movable between the solid and dotted line positions shown in FIG. 1 and are effective in printing a plurality of colors on the outer side of the particular web being run that corresponds to the position of the blanket roll with which it is operatively associated. As shown in FIG. 1, when the web depicted by numeral 22 is being run, the blanket rolls 18 and 20 are in their dotted line positions, and, when the web identified by numerals 24 is being run, the blanket rolls are in their solid line positions. FIG. 2 shows a modification of the roll arrangement in FIG. 1 and is provided with an additional blanket roll 26 and operatively associated therewith is an additional image delivering or plate roll 28.

With the roll arrangement shown in FIG. 1, three colors can be printed on one side of a paper web by offsetting two of the colors from one blanket roll. With the roll arrangement shown in FIG. 2, the same number of colors can be printed on one side of a web but it permits offsetting of each color separately.

It should be understood that the image delivering or plate rolls are provided with the usual thin printing plates (not shown) and, for the purpose of applying an ink film thereto, conventional ink fountains are utilized along with cooperating ink transfer rollers and cylinders which are not shown for they are not considered necessary for a complete understanding of the invention.

The mechanism for selectively moving the blanket rolls to the throw off position of FIG. 4 and from the latter to either of the positions shown in FIGS. 3 and 5 for the purpose of printing a plurality of colors on one side or the other of a paper web will now be described.

To effect movement of the blanket rolls, the ends of each are provided with stub shafts 30 which are journaled in an eccentric sleeve which, in turn, are journaled in aligned openings provided in the frame members 10.

The eccentric sleeve for supporting the blanket roll 18 is identified by the numeral 32. To rock the eccentric sleeve 32 either clockwise or counter-clockwise from a neutral or throw off position, the sleeve is provided with a radially extending arm 34 having a bore parallel to the axis of the roll and, by means of a pin 36, the arm is operatively connected to linkage yet to be described. To support the other blanket roll 20, an eccentric sleeve construction is utilized that is a mirror sleeve of that described supra for roll 18 and the corresponding parts are identified by corresponding reference numerals with the addition of a prime.

For the purpose of simultaneously rocking the eccentric sleeves 32, 32′ equal distances and in the same directions, a linkage is provided generally identified by the numeral 38.

To effect locating the eccentric sleeves 32, 32′ in a precise position when they are rocked in one direction or the other, the inner sides of the sleeves (not shown) are provided with integrally formed spaced abutments that are adapted to engage conventional type adjustable stop members (not shown) that are mounted on the inner surfaces of the frame members 10.

Figure 3:
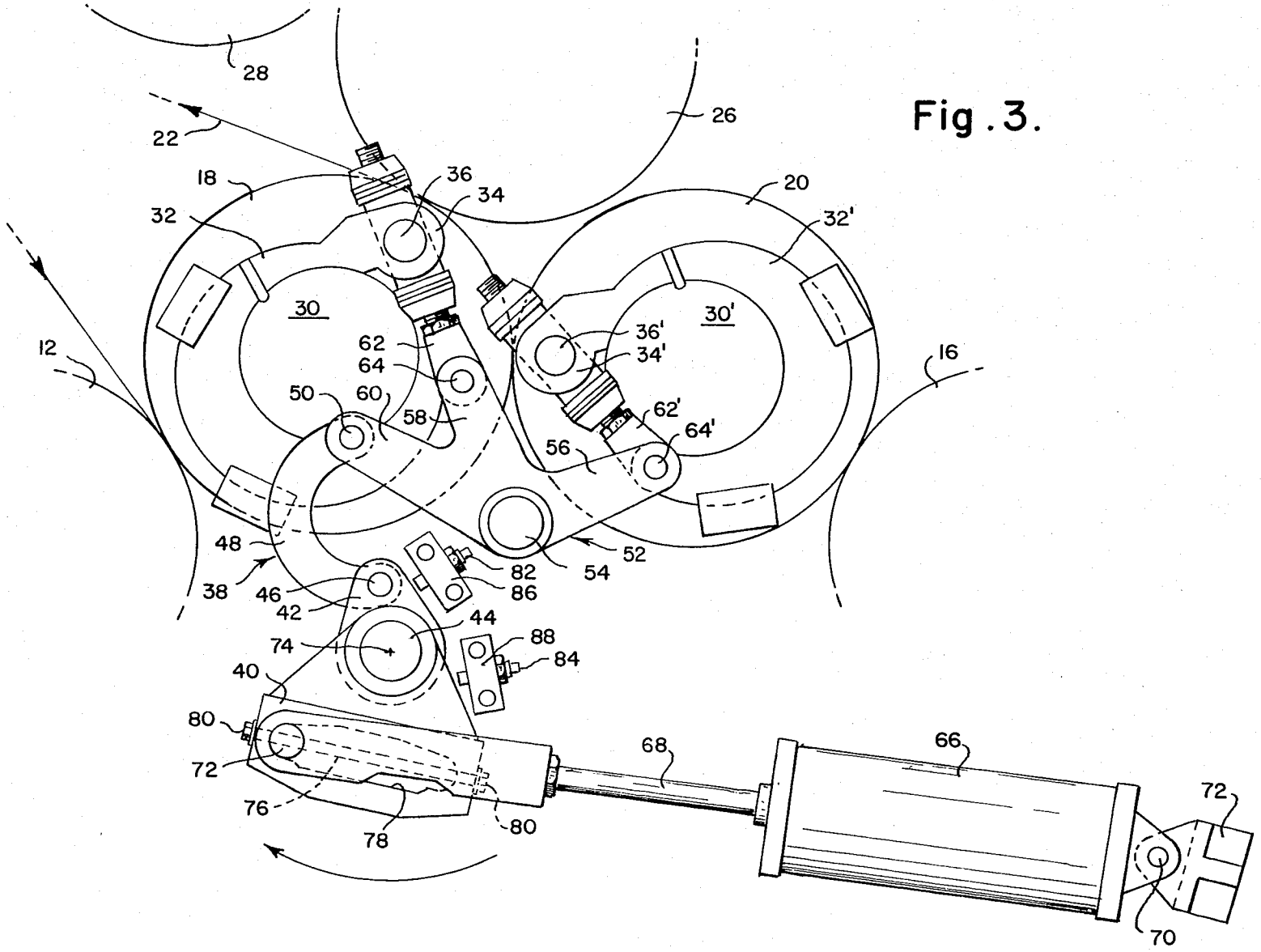
FIG. 3 is an end view of the image delivering and blanket rolls in the solid line position of FIG. 1 showing the control linkage and actuating member for moving the latter rolls simultaneously.
Figure 4:
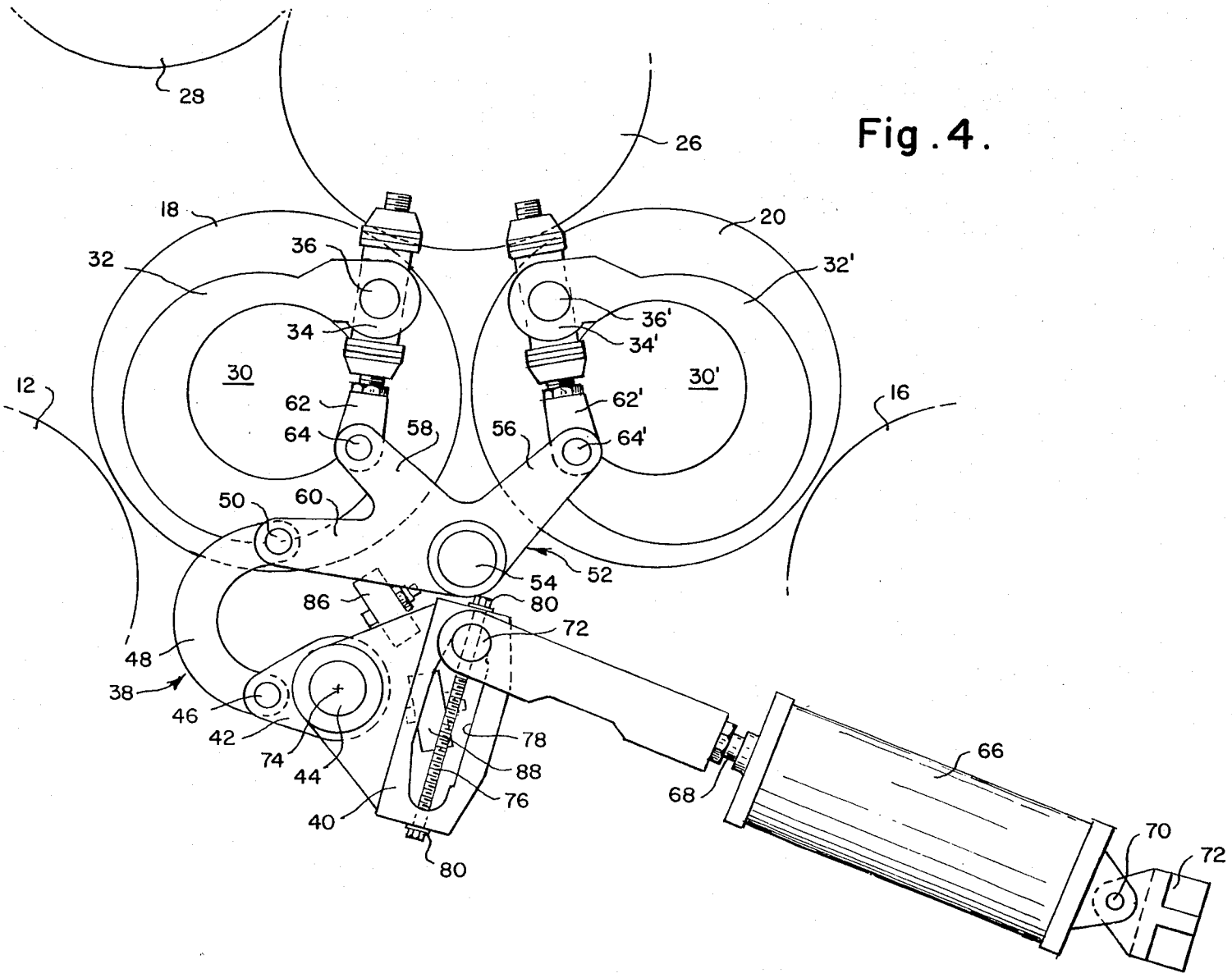
FIG. 4 is a view similar to FIG. 3 but showing the blanket rolls in their neutral or throw off position.
Figure 5:
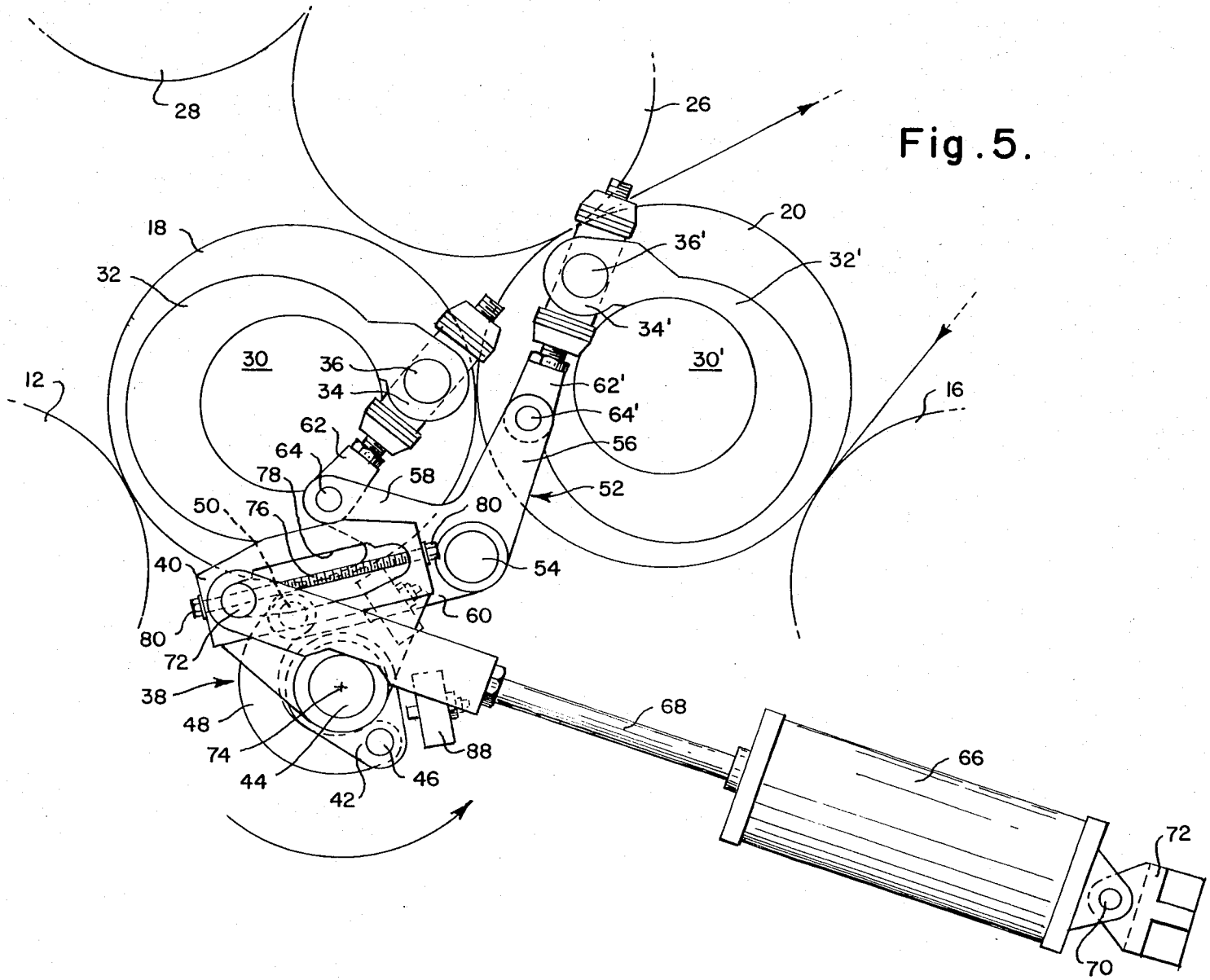
FIG. 5 is a view similar to FIG. 3 but showing the blanket rolls in the dotted line position of FIG. 1.

Referring to FIGS. 3, 4 and 5, the linkage 38 includes a first or input arm 40 and a second or operating arm 42 defining actuating linkages which are assembled together so as to move in unison on a shaft 44 extending from the frame 10. Attached to the end of the operating arm 42 by means of a pin 46 is an upwardly extending arcuated link member 48 which attaches by means of a pin 50 to a lever member generally indicated by numeral 52. This lever member 52 is pivotably mounted on a shaft 54 extending from the frame 10 and is of the three arm type. The lever's first arm is depicted by numeral 56, its second by numeral 58 and its third by numeral 60, the end of which is pivotably attached to the upper end of the arcuated lever 48 by means of pin 50. The second arm 58 has one end of a link member 62 pivotably connected thereto by means of a pin 64 and the opposite end of this link is connected to the radially extending arm 34 by means of the pin 36.

As the pin and link member connecting the lever's first arm to the radially extending arm 34′ are a mirror image of those connecting the second arm to arm 34, the corresponding parts are indicated by corresponding numerals with the addition of a prime.

It should be apparent that pivotal movement of the lever member 52 in a counter-clockwise direction from the FIG. 4 position will simultaneously move the eccentric sleeves 32, 32′ in the same directions so that their respective blanket rolls 18 and 20 will be moved to the positions shown in FIG. 5. Also, pivotal movement of the lever member 52 in a clockwise direction from the FIG. 4 position will simultaneously move the eccentric sleeves 32, 32′ in the same directions so that their respective blanket rolls 18 and 20 will move to the positions shown in FIG. 3.

It should be understood that means are provided for operatively connecting shaft 44 to linkage elements on the opposite side of the press so that the eccentric sleeves operatively associated with the blanket rolls 18 and 20 on that side will be actuated simultaneously with eccentric sleeves 32, 32′ and by a single fluid actuator 66 shown in FIGS. 3, 4 and 5. This fluid actuator 66 is of the double acting type having a plunger 68 and is attached at one end to a pivot 70 on a support bracket 72 which is fixed to the side of the frame 10.

For the purpose of causing the single double acting fluid actuator 66 to simultaneously pivot the lever members 52 on each side of the press in a clockwise or counter-clockwise direction from a mid position to position the blanket rolls in one of the other of their operating positions, means are provided for changing the point of connection at which the plunger 68 is attached to the input arm 40. This point of connection is formed by a pivot pin 72 which is capable of being shifted from one side to the other of the input arm's axis of rotation that is identified in FIGS. 3, 4 and 5 by numeral 74. When the pivot pin 72 has been shifted to one extreme position, a counter-clockwise torque is applied to the input arm 40 and when the pivot pin is in its opposite end position, clockwise torque is applied. This shifting of the pivot pin 72 is accomplished by providing a jackscrew 76 within the input arm 40 as shown in FIGS. 3, 4 and 5. This jackscrew 76 is threaded transversely in the pivot pin 72 and extends across an opening 78 formed in the input arm 40. The jackscrew 76 is maintained within the confines of the input arm 40 and its ends, which protrude from the input arm, are formed as hex heads 80 which may be engaged by any suitable turning tool. It should be apparent that by simply rotating one of the ends 80 of the jackscrew 76, the pivot pin 72 may be moved from one end to the other of the opening 78, thus shifting the center of application of force from one side of the input arm's axis of rotation 74 to the other.

To prevent movement of the input arm 40 beyond the required amount, the latter is caused to engage adjustable stop members 82 and 84 that are fixed in spaced relation on the side of the frame 10 by means of bracket 86 and 88, respectively.

Although not shown, it should be understood that the additional blanket roll 26 is controlled by a similar eccentric sleeve and control linkage as that operatively associated with the blanket rolls 18 and 20.

It should be apparent in view of the foregoing description that a reversible color deck apparatus has been provided for rotary printing presses which possesses a high degree of flexibility that permits selective printing of a plurality of colors on one side or the other of a paper web.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. A reversible color deck for a rotary press comprising:

(a) three delivering rolls spaced apart in a substantially triangular relationship with respect to each other;

(b) a pair of blanket rolls located within the space separating said image delivering rolls; and (c) eccentric mounting means supporting said blanket rolls for effecting simultaneous movement of the latter between positions where:

(i) a first one of said blanket rolls is in contact with two of said image delivering rolls and the second one of said blanket rolls is in contact with the remaining one of said image delivering rolls;

(ii) neither of said blanket rolls is in contact with any of said image delivering rolls; and (iii) said second blanket roll is in contact with two of said image delivering rolls and said first blanket roll is in contact with the remaining one of said image delivering rolls.

2. The structure according to claim 1, wherein said eccentric mounting means includes:

(a) an eccentric sleeve operatively connected to the ends of said blanket rolls;

(b) a lever member linked to said eccentric sleeves;

(c) actuating linkage connected to said lever member; and (d) a fluid actuator operatively connected to said actuating linkage.

3. The structure according to claim 2, wherein said lever member is of the three armed type with two arms being connected by linkage to said eccentric sleeves and the third arm linked to said actuating linkage.

4. The structure according to claim 2, wherein said fluid actuator is of the double acting type.

* * * * *